US009591898B2

(12) United States Patent
Burkhart-Day

(10) Patent No.: US 9,591,898 B2
(45) Date of Patent: Mar. 14, 2017

(54) REUSABLE ZIPPER SYSTEM

(71) Applicant: Re-U-Zip, LLC, Santa Monica, CA (US)

(72) Inventor: Eric Edgar Burkhart-Day, Santa Monica, CA (US)

(73) Assignee: Re-U-Zip, LLC, Santa Monica, CA (US)

( * ) Notice: Subject to any disclaimer, the term of this patent is extended or adjusted under 35 U.S.C. 154(b) by 168 days.

(21) Appl. No.: 14/610,129

(22) Filed: Jan. 30, 2015

(65) Prior Publication Data

US 2015/0216267 A1 Aug. 6, 2015

Related U.S. Application Data

(60) Provisional application No. 61/934,012, filed on Jan. 31, 2014.

(51) Int. Cl.

| | |
|---|---|
| ***A44B 19/24*** | (2006.01) |
| ***A44B 18/00*** | (2006.01) |
| ***A44B 19/34*** | (2006.01) |
| ***E04H 15/32*** | (2006.01) |

(52) U.S. Cl.

CPC ..... *A44B 19/24* (2013.01); *A44B 19/34* (2013.01); *E04H 15/32* (2013.01); *Y10T 24/25* (2015.01)

(58) Field of Classification Search

CPC ..... A44B 19/24; A44B 19/34; A44B 18/00; A44B 18/0088; Y10T 24/2708

See application file for complete search history.

(56) References Cited

U.S. PATENT DOCUMENTS

| | | | | | |
|---|---|---|---|---|---|
| 2,768,922 | A | * | 10/1956 | Klein | B29D 5/00 156/238 |
| 3,456,305 | A | | 7/1969 | Voit | |
| 3,538,914 | A | | 11/1970 | Myers | |
| 3,685,103 | A | * | 8/1972 | Severino | A41H 37/003 24/304 |
| 3,696,472 | A | * | 10/1972 | Perina | A44B 18/0003 24/427 |
| 3,785,014 | A | | 1/1974 | Canepa | |
| 3,883,381 | A | * | 5/1975 | Thaeler | A41H 37/06 156/66 |
| 3,925,858 | A | * | 12/1975 | Thaeler | A41H 37/003 156/66 |
| 4,083,582 | A | * | 4/1978 | Villafana | B42D 3/10 24/381 |
| 4,137,859 | A | * | 2/1979 | Itoh | A41H 37/003 112/475.09 |

(Continued)

*Primary Examiner* — Robert J Sandy

(74) *Attorney, Agent, or Firm* — Neustel Law Offices; Jason L. Gilbert

(57) ABSTRACT

A reusable zipper system for allowing a zipper to be installed and removed onto different objects interchangeably. The reusable zipper system generally includes an inner member and an outer member. The inner member is removably secured to an object via adhesive around an opening to be fitted with the present invention. The outer member is removably secured over the inner member. After cutting a slit through the inner member, a zipper assembly which includes zipper tracks and a zipper head may be used to selectively open or close the flaps. When desired, the inner and outer members may be removed from the object to be used elsewhere.

14 Claims, 10 Drawing Sheets

(56) References Cited

U.S. PATENT DOCUMENTS

| | | | | | |
|---|---|---|---|---|---|
| 5,067,207 | A * | 11/1991 | Semons | A41H 37/003 | 135/115 |
| 5,311,648 | A * | 5/1994 | Semons | B60J 11/00 | 135/115 |
| 5,819,474 | A * | 10/1998 | Strom | E04H 15/32 | 135/115 |
| 2005/0183247 | A1 * | 8/2005 | Berns | A41D 27/201 | 24/432 |
| 2008/0040837 | A1 * | 2/2008 | King | A41D 13/012 | 2/227 |
| 2010/0269312 | A1 | 10/2010 | Wagner | | |
| 2011/0068025 | A1 | 3/2011 | Whittemore | | |

* cited by examiner

REUSABLE ZIPPER SYSTEM

CROSS REFERENCE TO RELATED APPLICATIONS

I hereby claim benefit under Title 35, United States Code, Section 119(e) of U.S. provisional patent application Ser. No. 61/934,012 filed Jan. 31, 2014. The 61/934,012 application is currently pending. The 61/934,012 application is hereby incorporated by reference into this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to a reusable zipper and more specifically it relates to a reusable zipper system for allowing a zipper to be installed and removed onto different objects interchangeably.

Description of the Related Art

Any discussion of the related art throughout the specification should in no way be considered as an admission that such related art is widely known or forms part of common general knowledge in the field.

Zippers are generally permanently attached to various objects surround openings meant to be selectively opened and/or closed. Other types of objects with such openings may omit zippers entirely. Thus, it would be preferable to have a system for removably securing a zipper assembly to various objects such that the zipper assembly may be removed when needed. Current zipper arrangements which are permanently attached cannot be removed without compromising their functionality. Thus, removal of such permanently-attached zippers will often requirement the purchase of a completely new replacement zipper as well as the effort for reinstalling it.

Because of the inherent problems with the related art, there is a need for a new and improved reusable zipper system for allowing a zipper to be installed and removed onto different objects interchangeably.

BRIEF SUMMARY OF THE INVENTION

The invention generally relates to a reusable zipper system which includes an inner member and an outer member. The inner member is removably secured to an object via adhesive around an opening to be fitted with the present invention. The outer member is removably secured over the inner member. After cutting a slit through the inner member, a zipper assembly which includes zipper tracks and a zipper head may be used to selectively open or close the flaps. When desired, the inner and outer members may be removed from the object to be used elsewhere.

There has thus been outlined, rather broadly, some of the features of the invention in order that the detailed description thereof may be better understood, and in order that the present contribution to the art may be better appreciated. There are additional features of the invention that will be described hereinafter and that will form the subject matter o f the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
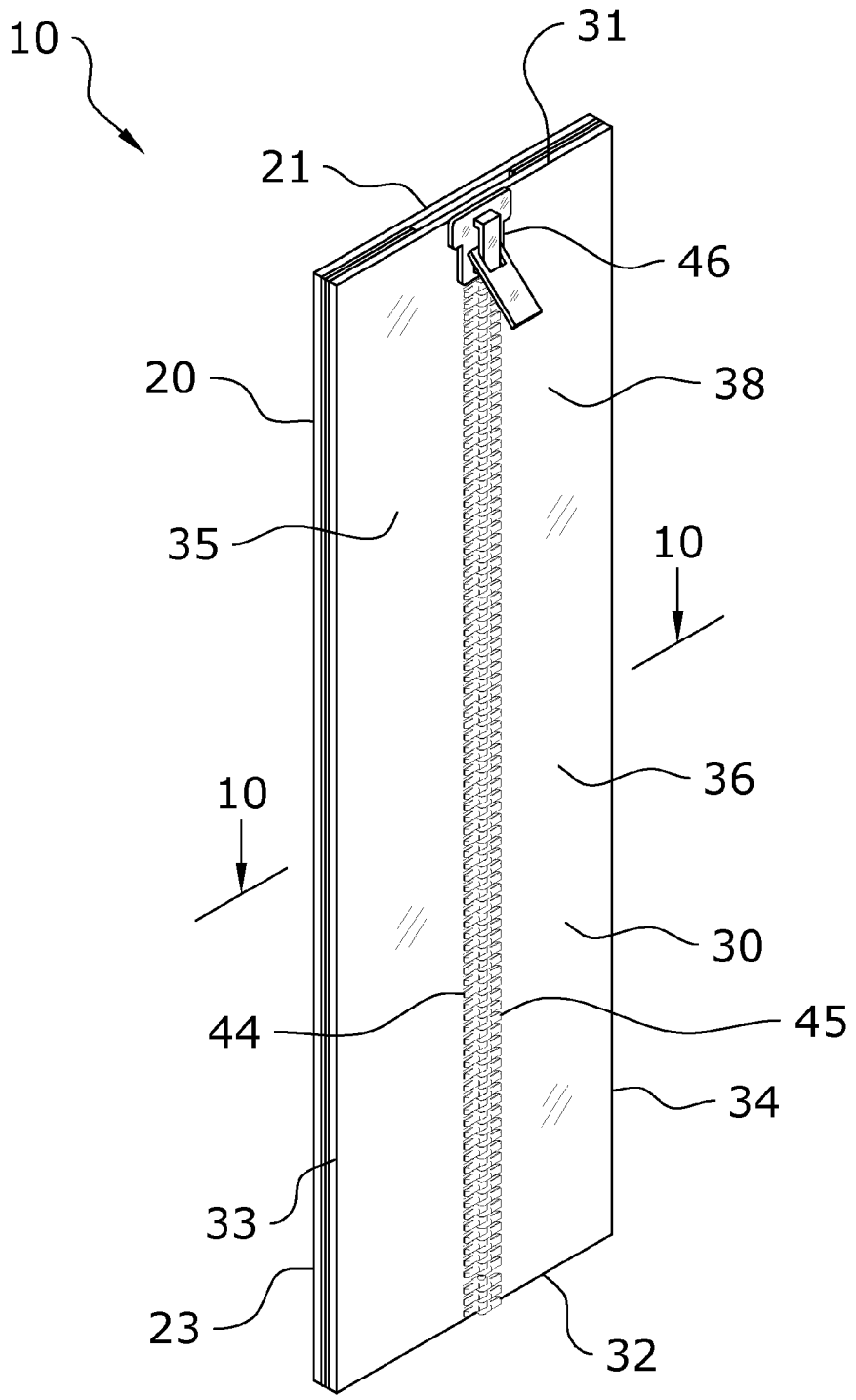
FIG. 1 is an upper perspective view of the present invention.

A. Overview.

Turning now descriptively to the drawings, in which similar reference characters denote similar elements throughout the several views, FIGS. 1 through 10 illustrate a reusable zipper system 10, which comprises an inner member 20 and an outer member 30. The inner member 20 is removably secured to an object 11 via adhesive 27 around an opening 13 to be fitted with the present invention. The outer member 30 is removably secured over the inner member 20. After cutting a slit through the inner member 20, a zipper assembly which includes zipper tracks 44, 45 and a zipper head 46 may be used to selectively open or close the flaps 15. When desired, the inner and outer members 20, 30 may be removed from the object 11 to be used elsewhere.

B. Inner Member.

Figure 2:
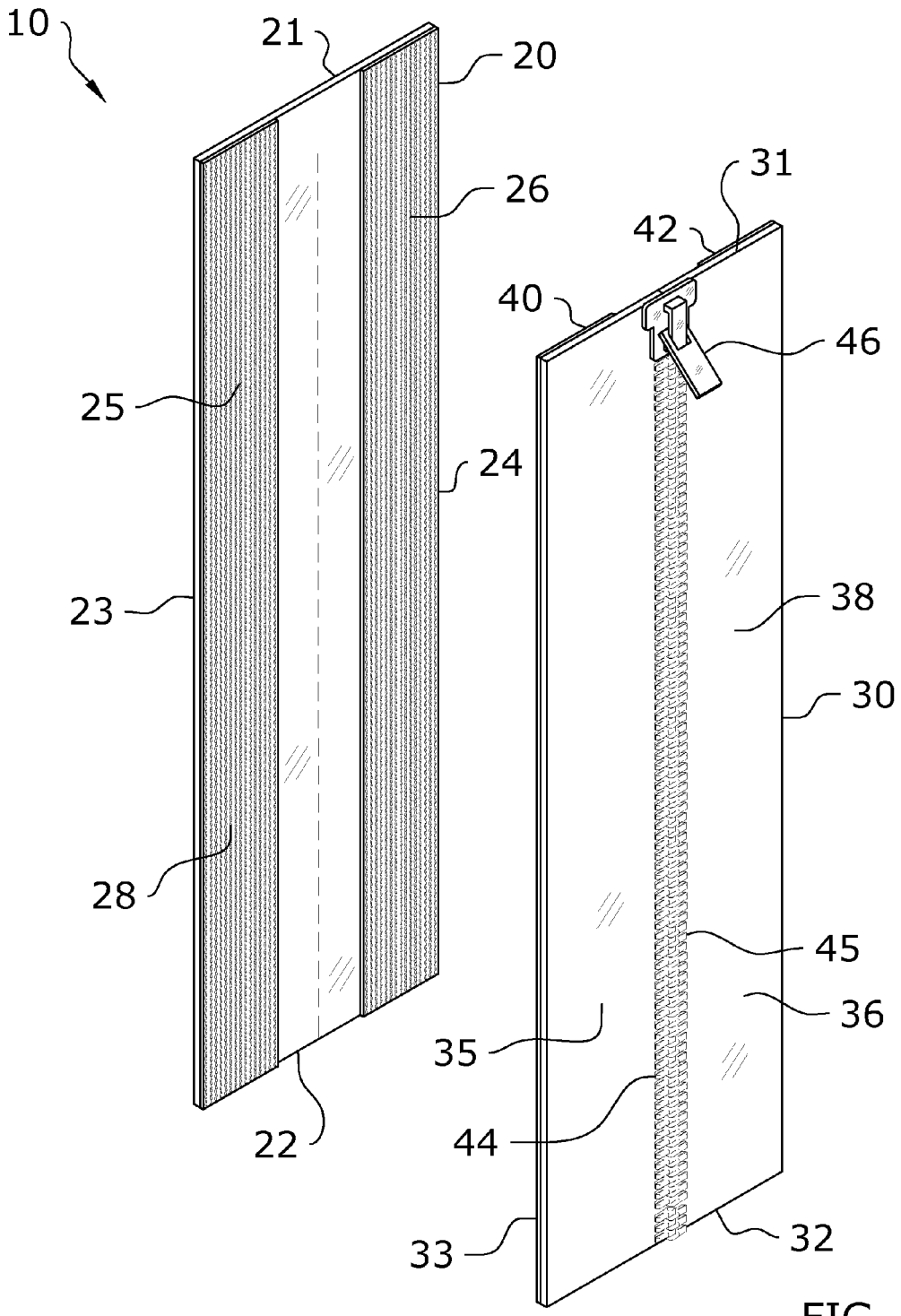
FIG. 2 is a frontal upper perspective view of the present invention.
Figure 3:
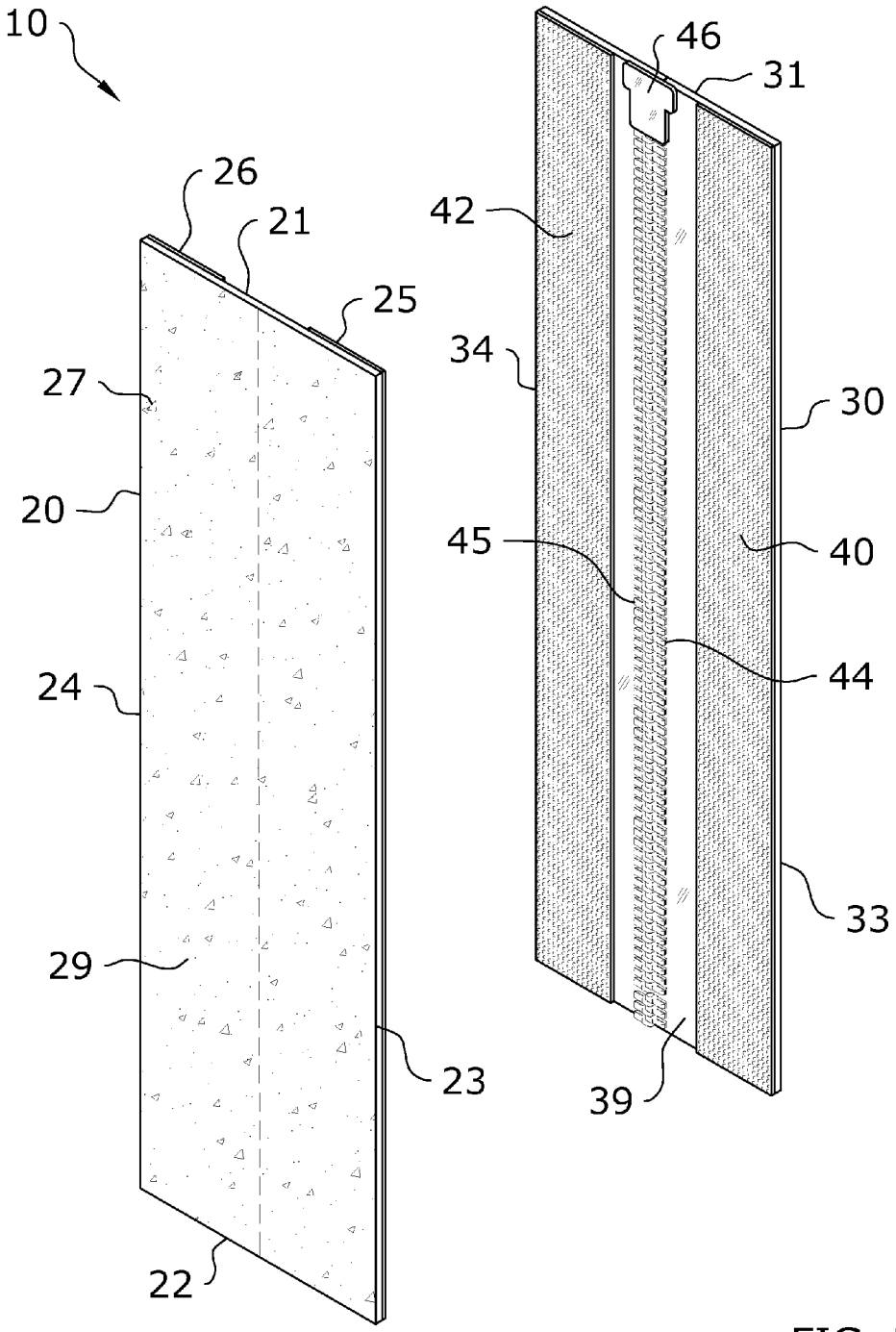
FIG. 3 is a rear upper perspective view of the present invention.

As best shown in FIGS. 1-3, the present invention includes an inner member 20 which is secured to the structure which is being removably fitted with the present invention. The inner member 20 is illustrated as being comprised of an elongated strip, though it should be appreciated that this is merely an exemplary embodiment. Thus, the shape, size, configuration, and orientation of the inner member 20 may vary in different embodiments of the present invention.

In the exemplary embodiment best shown in FIGS. 2-3, the inner member 20 comprises an elongated configuration having an upper end 21, a lower end 22, a first side 23, and a second side 24. The inner member 20 includes connector strips 25, 26 on its outer surface 28 and an adhesive 27 on its inner surface 20. The inner surface 20 of the inner member 20 is removably secured to the object 11 being fitted with the present invention. The outer surface 28 of the inner member 20 is removably secured to the outer member 30 of the present invention as discussed herein.

The connector strips 25, 26 of the inner member 20 are utilized for securing the inner member 20 removably to the outer member 30. Thus, the connector strips 25, 26 are preferably positioned on the outer surface 28 of the inner member 20 as shown in FIG. 2. In such a preferred embodiment, the connector strips 25, 26 are shown as extending along the first and second sides 23, 24 of the outer surface 28 of the inner member 20 between its upper and lower ends 21, 22.

In the preferred embodiment shown in FIG. 2, a first connector strip 25 extends between the upper and lower ends 21, 22 of the outer surface 28 of the inner member 20 near its first side 23 and the second connector strip 26 extends in parallel orientation with respect to the first connector strip 25 near the second side 24 of the outer surface 28 of the inner member 20. It should be appreciated that the connector strips 25, 26 may be comprised of different shapes, sizes, configuration, and orientations than shown in the figures.

The connector strips 25, 26 are shown as comprising hook-and-loop fasteners. However, it should be appreciated that the connector strips 25, 26 may in alternate embodiments comprise other structures or substances to connect the inner and outer members 20, 30 together. For example, the connector strips 25, 26 may in some embodiments comprise an adhesive, clasps, buttons, or the like.

The inner surface 29 of the inner member 20 is best shown in FIG. 3. The inner surface 29 of the inner member 20 is adapted to be removably secured to the object 11 being fitted with the present invention. Thus, the inner surface 29 of the inner member 20 generally includes an adhesive 27 for securing the inner member 20 removably to the object 11. The type of adhesive 27 may vary in different embodiments, as well as the amount of adhesive 27 utilized and the positioning and orientation of the adhesive 27 on the inner surface 29 of the inner member 20.

C. Outer Member.

As shown throughout the figures, the present invention includes an outer member 30 which is removably secured to the inner member 20 of the present invention. The outer member 30 is illustrated as being comprised of an elongated strip, though it should be appreciated that this is merely an exemplary embodiment. Thus, the shape, size, configuration, and orientation of the outer member 30 may vary in different embodiments of the present invention.

In the exemplary embodiment best shown in FIG. 2, the outer member 30 comprises an elongated configuration having an upper end 31, a lower end 32, a first side 33, and a second side 34. The outer member 30 includes connector strips 40, 42 on its inner surface 39. The inner surface 39 of the outer member 30 is removably secured to the inner member 20 of the present invention. The outer surface 38 of the outer member 30 includes the zipper 46 of the present invention.

The connector strips 40, 42 of the outer member 30 are utilized for securing the outer member 30 removably to the inner member 20. Thus, the connector strips 40, 42 are preferably positioned on the inner surface 39 of the outer member 30 as shown in FIG. 3. In such a preferred embodiment, the connector strips 40, 42 are shown as extending along the first and second sides 33, 34 of the inner surface 39 of the outer member 30 between its upper and lower ends 31, 32.

In the preferred embodiment shown in FIG. 3, a first connector strip 40 extends between the upper and lower ends 31, 32 of the inner surface 39 of the outer member 30 near its first side 33 and the second connector strip 42 extends in parallel orientation with respect to the first connector strip 40 near the second side 34 of the inner surface 39 of the outer member 30. It should be appreciated that the connector strips 40, 42 may be comprised of different shapes, sizes, configuration, and orientations than shown in the figures.

The connector strips 40, 42 are shown as comprising hook-and-loop fasteners. However, it should be appreciated that the connector strips 40, 42 may in alternate embodiments comprise other structures or substances to connect the inner and outer members 20, 30 together. For example, the connector strips 40, 42 may in some embodiments comprise an adhesive, clasps, buttons, or the like.

The outer member 30 generally includes a first portion 35 and a second portion 36, with the first portion 35 including the first side 33 of the outer member 30 and the second portion 36 including the second side 34 of the outer member 30. The first and second portions 35, 36 of the outer member 30 are removably connected to each other via a zipper. The first portion 35 will thus include a first zipper track 44 and the second portion 36 includes a second zipper track 45. The zipper tracks 44, 45 are connected or disconnected to/from each other via a zipper head 46.

D. Operation of Preferred Embodiment.

Figure 4:
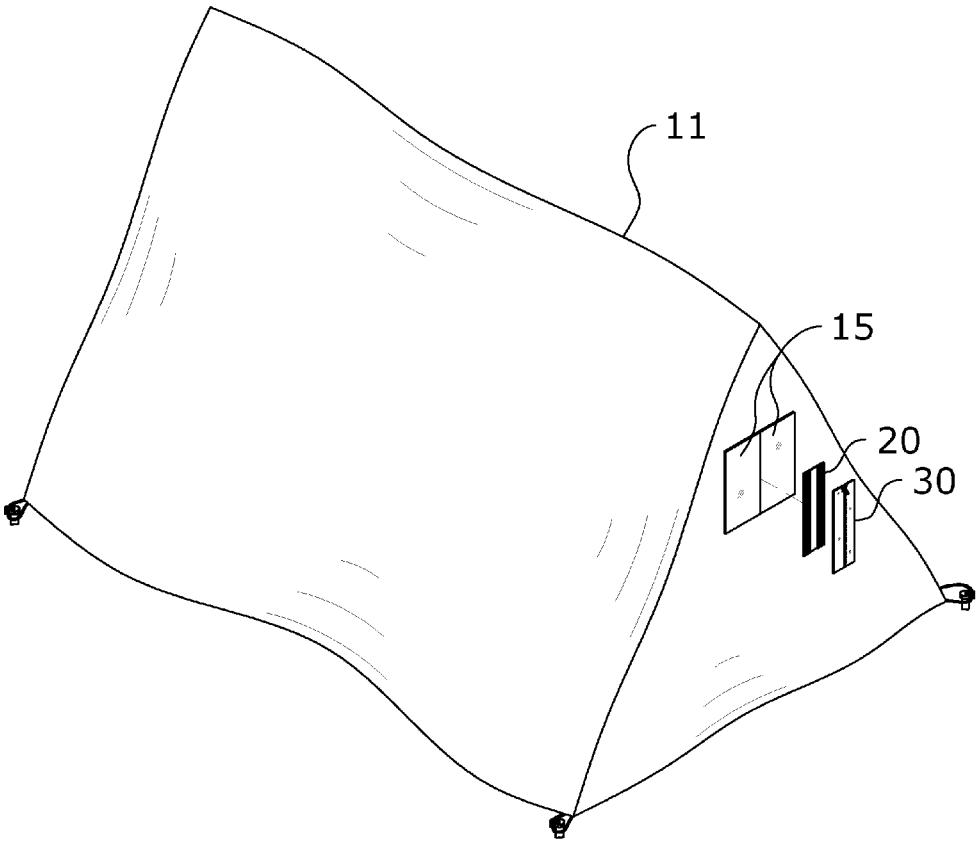
FIG. 4 is an upper perspective view of the present invention being installed on an object.
Figure 5:
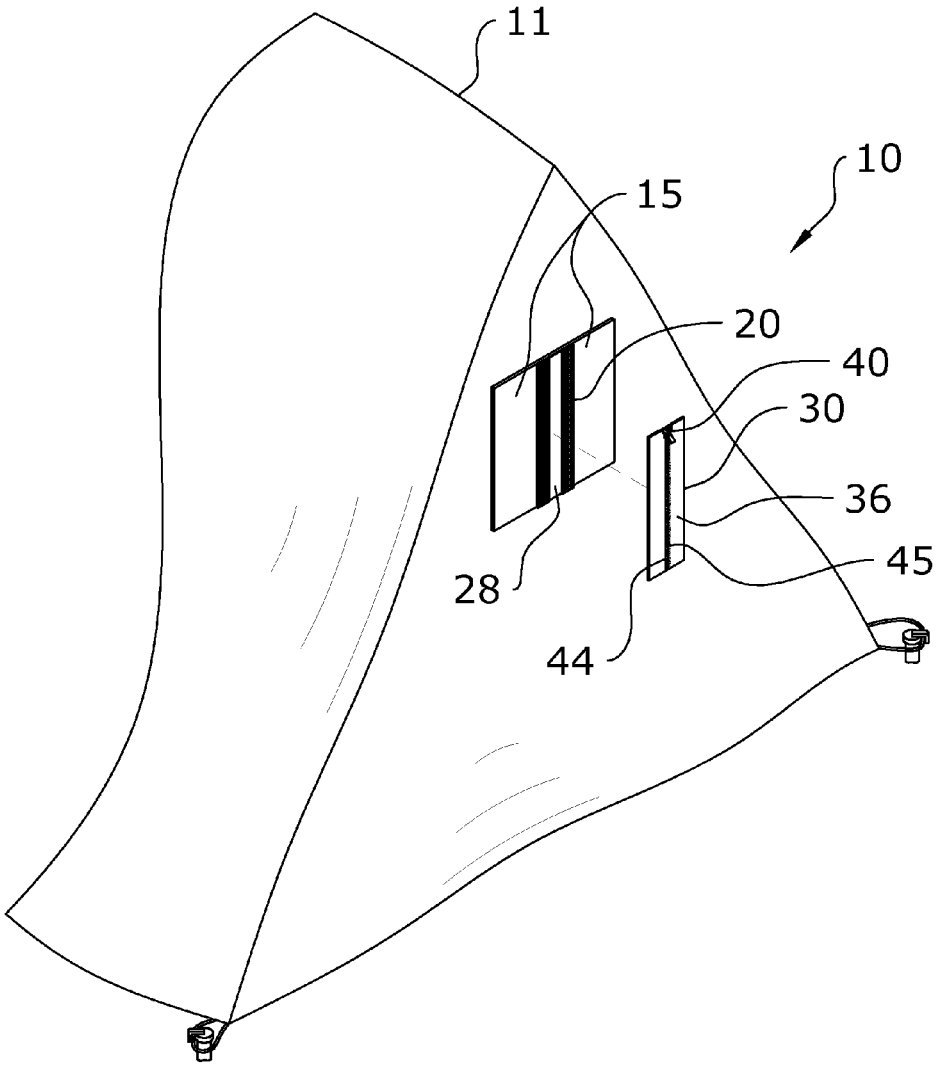
FIG. 5 is an upper perspective view of the inner member secured to an object.

The figures illustrate a window being fitted in a tent 11, though the present invention may be utilized with a wide range of objects 11, such as garments, blankets, and the like. In use, the inner member 20 is first removably secured to the object 11 being fitted with the present invention as shown in FIG. 4. Generally, the inner surface 29 of the inner member 20 will be placed against the object 11 at the desired area to be fitted with a zipper. In some embodiments, a cover (not shown) may first need to be removed from covering the adhesive 27. In any case, the adhesive 27 will removably secure the inner member 20 to the object 20.

Figure 6:
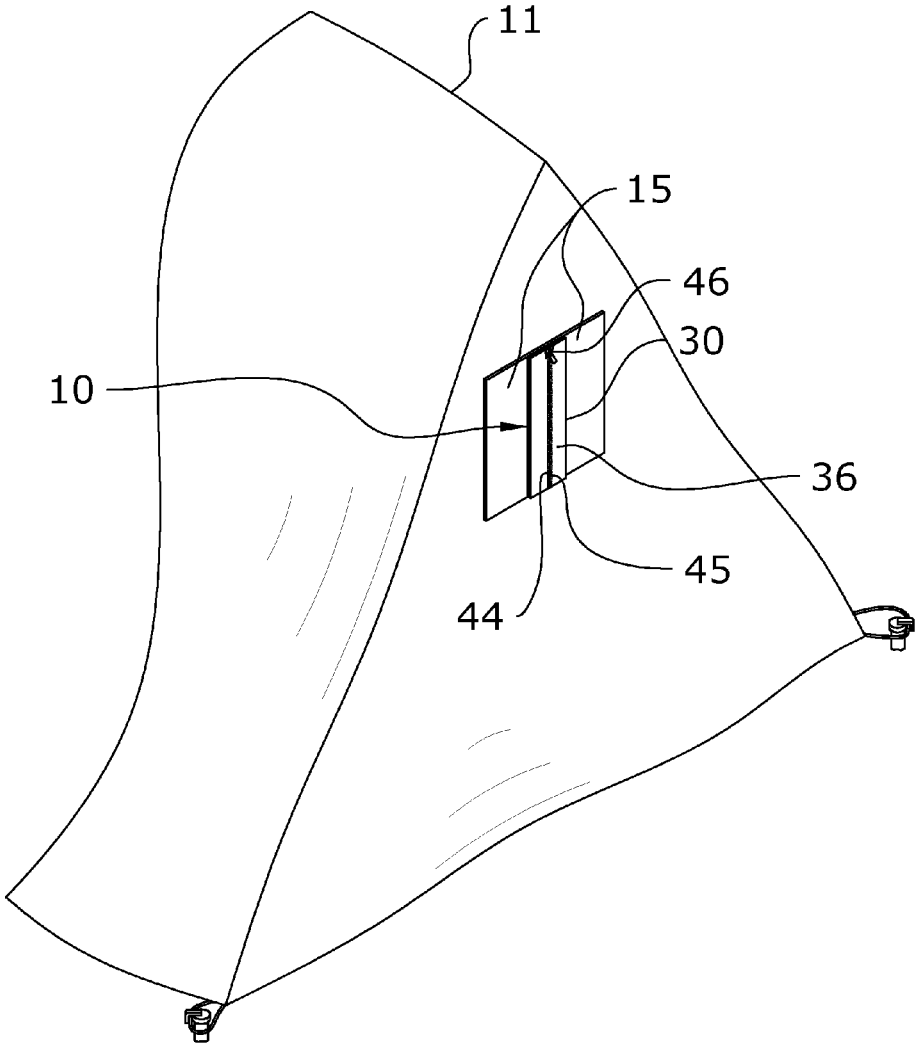
FIG. 6 is an upper perspective view of the inner and outer members both secured to an object.

With the inner member 20 secured to the object 11, the outer member 30 may be secured to the inner member 20. The inner surface 39 of the outer member 30 is secured against the outer surface 28 of the inner member 20 by aligning the first connector strip 25 of the inner member 20 with the first connector strip 40 of the outer member 30 as well as the second connector strip 26 of the inner member 20 with the second connector strip 42 of the outer member 30 so that the connector strips 25, 26, 40, 42 are engaged with each other by the hook-and-loop fasteners as shown in FIG. 6.

Figure 7:
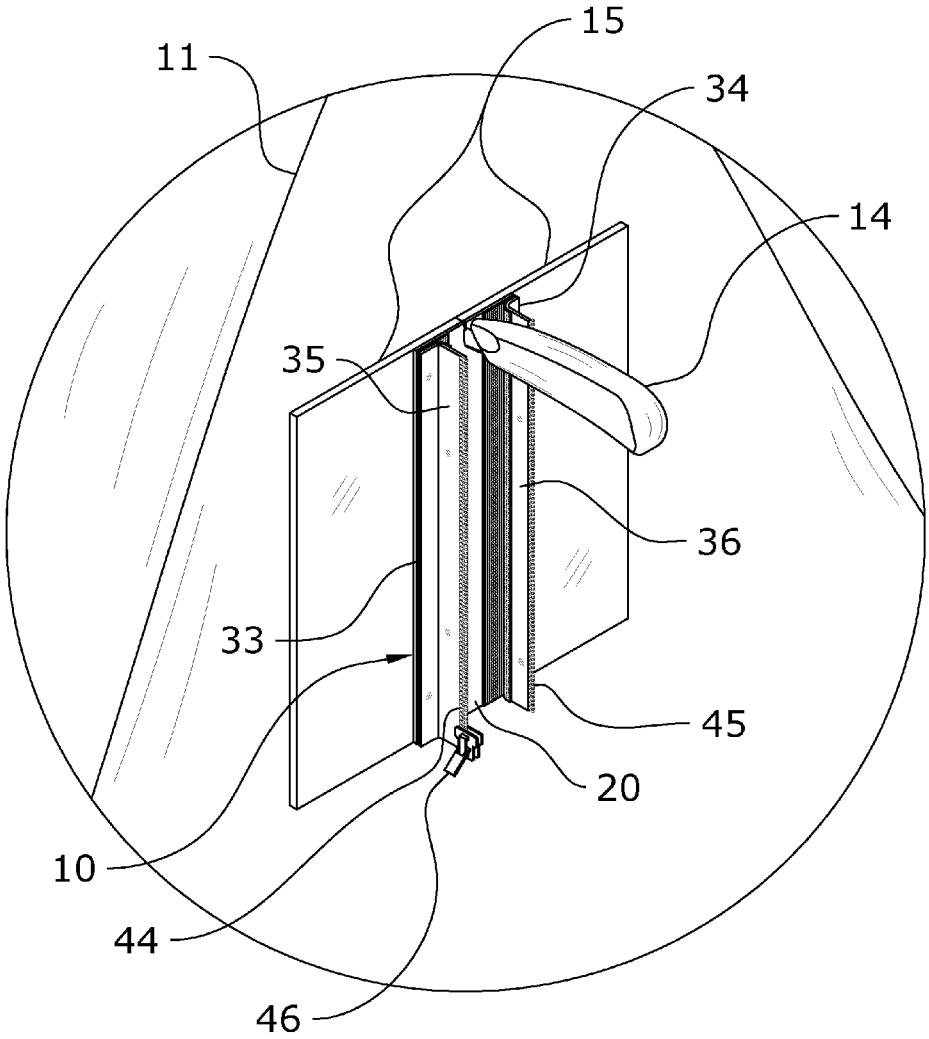
FIG. 7 is a first upper perspective view of the inner member being cut into two portions.
Figure 8:
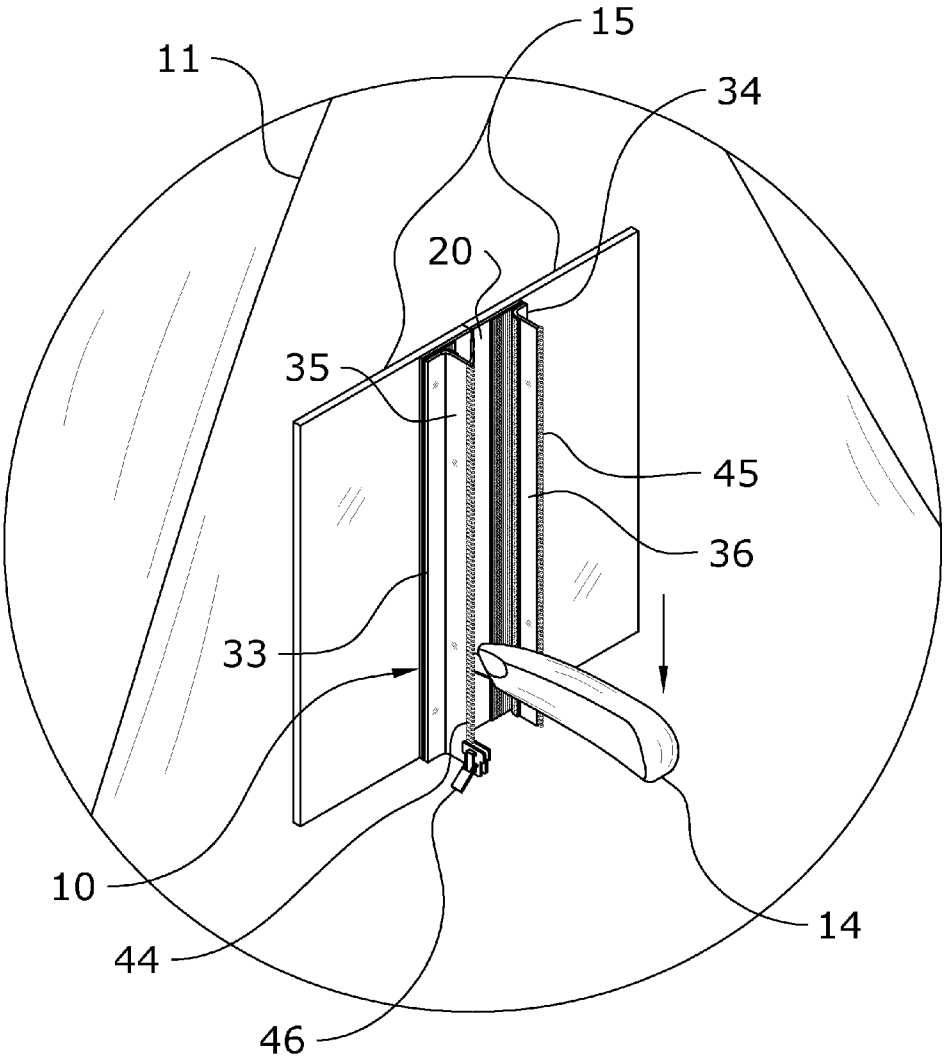
FIG. 8 is a second upper perspective view of the inner member being cut into two portions.
Figure 9:
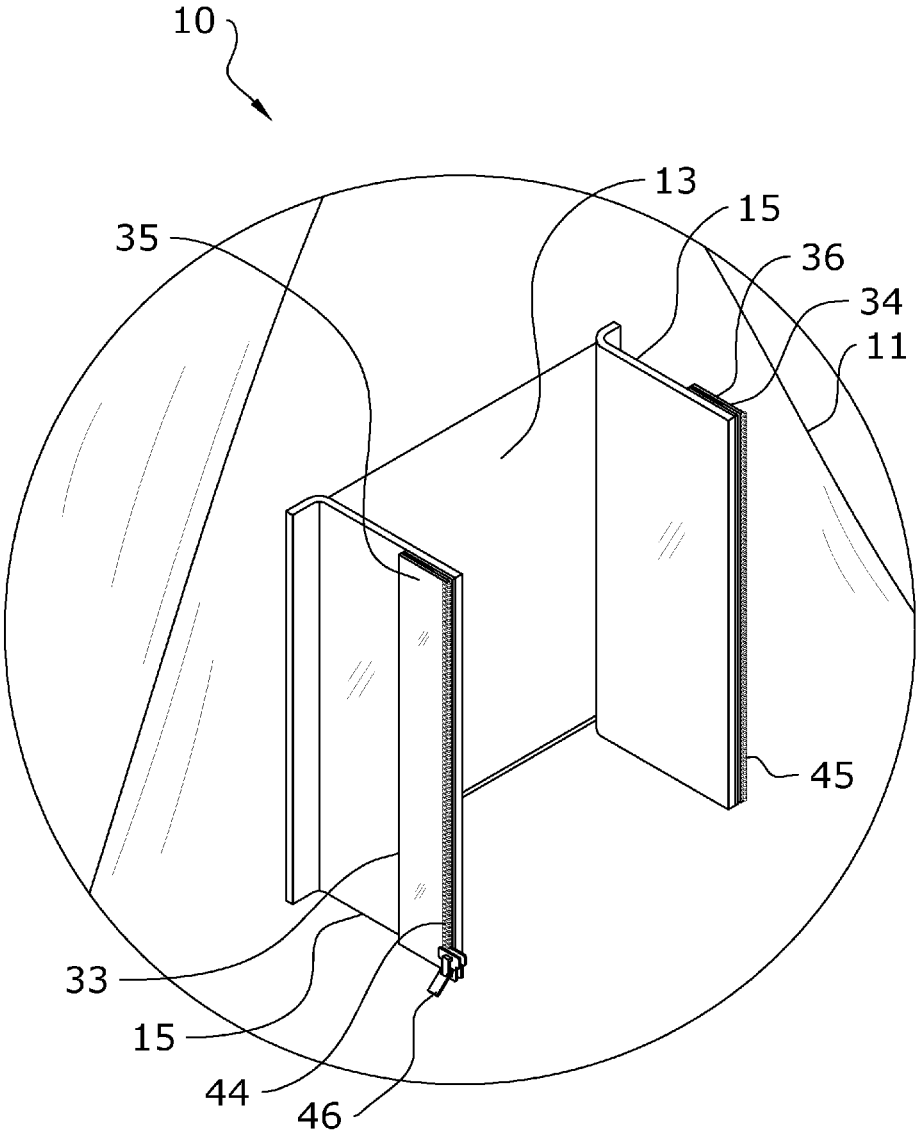
FIG. 9 is an upper perspective view of the present invention installed on flaps surrounding an opening in an object.
Figure 10:
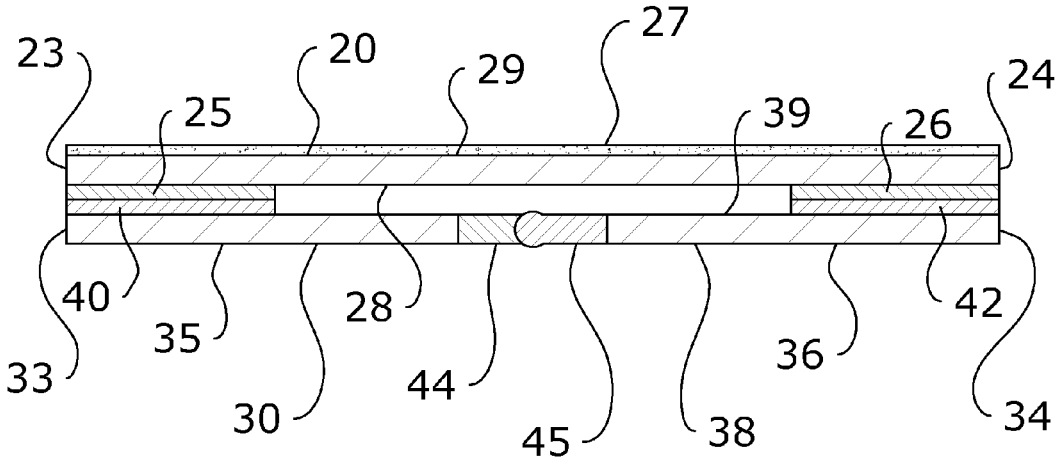
FIG. 10 is a sectional view of the present invention.

With the inner and outer member 20, 30 secured to each other, the first and second portions 35, 36 of the outer member 30 are separated from each other via the zipper head 46. A cutting tool 14 is then used to cut a line between the upper end 21 and lower end 22 of the inner member 20 to separate it into two portions as shown in FIGS. 7 and 8. As shown in FIG. 9, the inner and outer members 20, 30 are secured to both flaps 15 surrounding an opening 13 in the object 11. The zipper head 46 may now be utilized to secure the flaps 15 together or remove them.

When desired, the inner and outer members 20, 30 may be removed for further use on other objects 11. Either the inner member 20, the outer member 30, or both may contain a connector tab such as a piece of Velcro (not shown) which allows the present invention to be rolled onto itself for easy storage and transfer.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A reusable zipper system, comprising:

an inner member adapted to be secured to an object, wherein the inner member comprises an elongated strip having an outer surface, an inner surface, a first side, and a second side;

a first connector strip extending along said first side of said outer surface of said inner member;

a second connector strip extending along said second side of said outer surface of said inner member;

an outer member removably secured to said outer surface of said inner member, wherein said outer member includes a first portion and a second portion;

a third connector strip extending along a first side of an inner surface of said outer member;

a fourth connector strip extending along a second side of an inner surface of said outer member, wherein said third connector strip is adapted to removably engage with said first connector strip, wherein said fourth connector strip is adapted to removably engage with said second connector strip;

a first zipper track on said first portion;

a second zipper track on said second portion; and an adhesive on an inner surface of said inner member.

2. The reusable zipper system of claim 1, wherein said first connector strip and said second connector strip of said inner member each extend between an upper end and a lower end of said inner member.

3. The reusable zipper system of claim 2, wherein said first connector strip and said second connector strip of said inner member are parallel.

4. The reusable zipper system of claim 1, wherein said first connector strip and said second connector strip of said outer member each extend between an upper end and a lower end of said outer member.

5. The reusable zipper system of claim 3, wherein said first connector strip and said second connector strip of said inner member are each comprised of hook-and-loop fasteners.

6. The reusable zipper system of claim 1, further comprising a zipper head connected between said first zipper track and said second zipper track.

7. A reusable zipper system, comprising:

an inner member adapted to be secured to an object, wherein the inner member comprises an elongated strip having an outer surface, an inner surface, a first side, and a second side;

a first connector strip extending along said first side of said outer surface of said inner member;

a second connector strip extending along said second side of said outer surface of said inner member;

an outer member removably secured to said inner member, wherein said outer member includes a first portion and a second portion;

a third connector strip extending along a first side of an inner surface of said outer member;

a fourth connector strip extending along a second side of an inner surface of said outer member, wherein said third connector strip is adapted to removably engage with said first connector strip, wherein said fourth connector strip is adapted to removably engage with said second connector strip;

a first zipper track on said first portion;

a second zipper track on said second portion;

a cutting tool for cutting a slit within said inner member; and an adhesive on said inner member.

8. The reusable zipper system of claim 7, wherein said adhesive is comprised of glue.

9. The reusable zipper system of claim 7, wherein said connector strips each comprise a hook-and-loop fastener.

10. The reusable zipper system of claim 7, wherein said cutting tool comprises a knife.

11. The reusable zipper system of claim 7, wherein said first zipper track and said second zipper track are interconnected by a zipper head.

12. The reusable zipper system of claim 7, wherein said adhesive is on an inner surface of said inner member.

13. A reusable zipper system, comprising:

an inner member adapted to be secured to an object, wherein the inner member comprises an elongated strip having an outer surface, an inner surface, a first side, and a second side;

a first connector strip extending along said first side of said outer surface of said inner member;

a second connector strip extending along said second side of said outer surface of said inner member;

an outer member removably secured to said inner member, wherein said outer member includes a first portion and a second portion, wherein said outer member comprises the same shape and size as the inner member;

a third connector strip extending along a first side of an inner surface of said outer member;

a fourth connector strip extending along a second side of an inner surface of said outer member, wherein said third connector strip is adapted to removably engage with said first connector strip, wherein said fourth connector strip is adapted to removably engage with said second connector strip;

a first zipper track on said first portion;

a second zipper track on said second portion;

a zipper head connecting said first zipper track and said second zipper track;

a cutting tool for cutting a slit within said inner member; and an adhesive on an inner surface said inner member.

14. The reusable zipper system of claim 13, wherein said adhesive is comprised of glue and wherein said connector strips each comprise a hook-and-loop fastener.

* * * * *